United States Patent [19]

Meier et al.

[11] 4,388,007

[45] Jun. 14, 1983

[54] LINE FEED CARRIER RETURN MECHANISM FOR MOVABLE PRINTING POINT TYPEWRITER

[75] Inventors: Heinz Meier; Egon Zurawski, both of Berlin, Fed. Rep. of Germany

[73] Assignee: Triumph-Adler A.G. fur Buro- und Informationstechnik, Nuremberg, Fed. Rep. of Germany

[21] Appl. No.: 286,579

[22] Filed: Jul. 24, 1981

[30] Foreign Application Priority Data

Sep. 16, 1980 [DE] Fed. Rep. of Germany ..... 3034836

[51] Int. Cl.[3] ..... B41J 19/70; B41J 19/72

[52] U.S. Cl. ..... 400/314; 400/314.6; 400/315

[58] Field of Search ..... 400/314, 314.6, 315, 400/314.3

[56] References Cited

U.S. PATENT DOCUMENTS 2,902,133 9/1959 Walton et al. ..... 400/314.6

2,938,618 5/1960 Niccolls ..... 400/315

*Primary Examiner*—Edgar S. Burr

*Assistant Examiner*—David A. Wiecking

*Attorney, Agent, or Firm*—Joseph R. Spalla

[57] ABSTRACT

In a movable printing point typewriter wherein line feed mechanism on a stationary platen is driven by type element carrier drive mechanism, provision is made to detect the distance of the carrier from an established left margin and, if it is too short, to move the carrier first in escapement direction a sufficient distance from the left margin and then in carrier return direction so that a line feed can be completed before the carrier is returned to the left margin.

3 Claims, 3 Drawing Figures

LINE FEED CARRIER RETURN MECHANISM FOR MOVABLE PRINTING POINT TYPEWRITER

Figure 1:
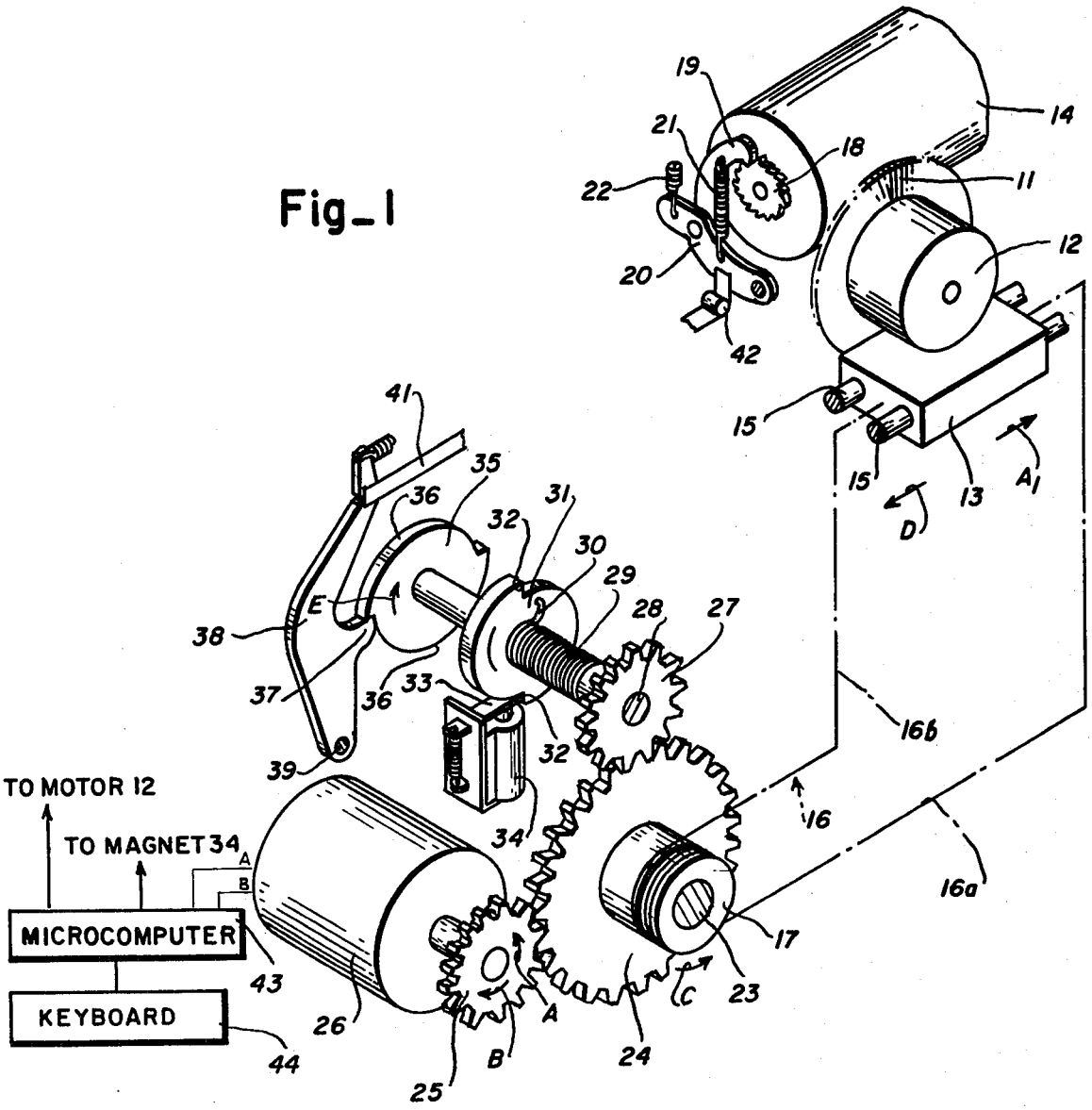

This invention relates to line feed carrier return mechanism for movable printing point typewriters; more particularly it relates to line feed carrier return mechanism having means for coupling the line feed mechanism to the carrier return drive to be driven thereby; and specifically to line feed carrier return mechanism having means responsive to a carrier return signal for first moving the print element carrier in escapement direction and then in carrier return direction if the position of the print element carrier is within a predetermined zone measured from the left margin to assure that the carrier return movement will effect a complete line feed.

As is usual in typewriters a line spacing automatically occurs in connection with a carriage return. In movable printing point typewriters, as for example, U.S. Pat. Nos. 2,902,133 and 4,215,944, the printing element carrier and the line feed mechanism on a stationary platen are usually powered by separate actions. This makes movable printing point typewriter production more expensive to a not inconsiderable extent.

DE OS No. 1 059 154 discloses a movable printing point typewriter in which a signal motor is utilized to position a printing element, to move the printing element carrier and to effect line spacing incident to a carrier return. Line spacing is effected by the carrier which, before reaching the left margin, strikes a double armed lever, causing it to pivot and effect a line space. There is no disclosure, however, as to how a line space can be effected if the return key is actuated while the carrier is in a position close to the left margin and is still interacting with said lever.

In accordance with the invention line feed mechanism in operative incident and in response to carrier return movement, and should the distance through which the carrier is to return too short to produce a line feed provision is made to move the carrier first in an escapement direction beyond a zone close to the left margin before moving the carrier in a carrier return direction to assure sufficient carrier return movement to operate the line feed mechanism driven thereby.

An object of the invention is to provide line spacing mechanism for movable printing point typewriters which becomes effective in connection with the return movement of the printing point carrier and which is simple in design, reliable in operation, and as noiseless as possible.

Another object of the invention is in the provision of a line feed carrier return arrangement wherein the line feed mechanism is driven by carrier return drive, and in the provision of means to assure the carrier return drive is energized over a sufficient time to effect a line feed operation.

Figure 2:
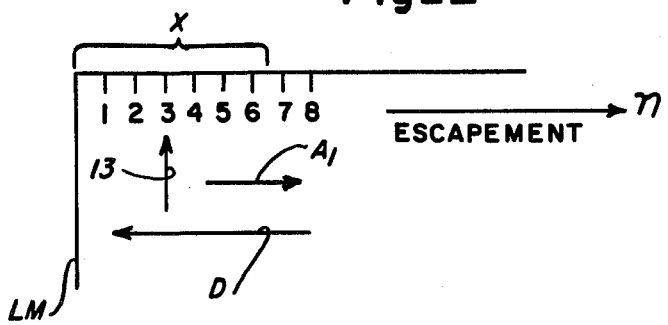
Figure 3:
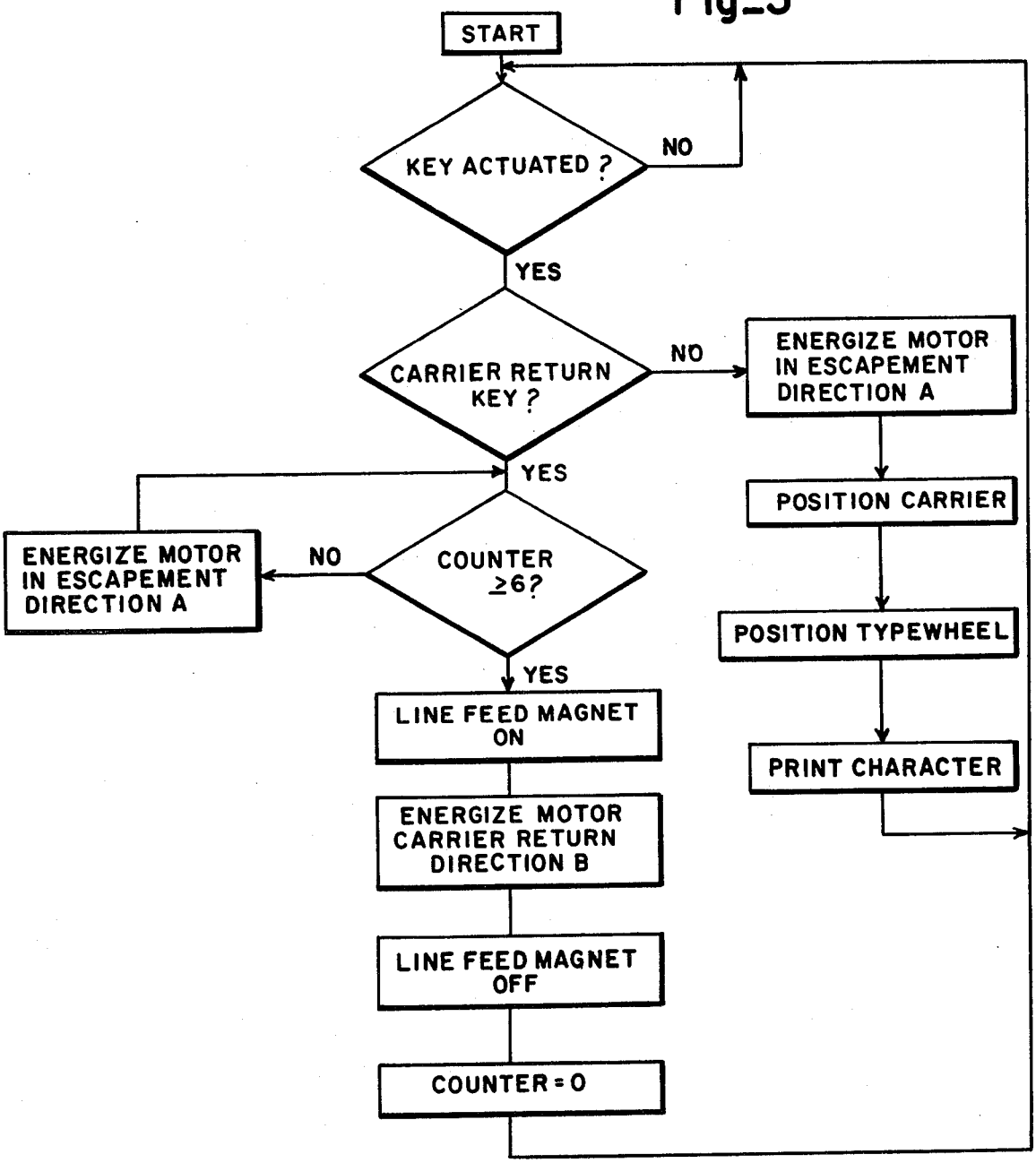

Other objects, features, and advantages of the present invention will become known to those skilled in the art from a reading of the following detailed description when taken in conjunction with the accompanying drawing wherein like reference numerals designate like or corresponding parts throughout the several views thereof, and wherein:

FIG. 1 a perspective view of a line space carrier return mechanism in accordance with the invention;

FIG. 2 is a view illustrating carrier positions relative to a left margin and movements thereof when the carrier is within a zone adjacent the left margin when a carrier return signal occurs; and FIG. 3 is a flow chart showing the sequence of operation of a line feed carrier return function.

Referring now to the drawing there is shown in FIG. 1 a movable printing point typewriter having a single daisy wheel type element 11 and a positioning motor 12 mounted on a movable carrier 13 for movement in escapement and carriage return directions, $A_1$, and D respectively, relative to a platen 14 rotatably mounted in a machine frame. As shown the carrier 13 is supported for movement on guide rods 15 and is moved by a carrier drive system comprising a cable 16 which is wound on a pulley 17 and has its ends connected to opposite sides of the carrier 13.

A ratchet wheel 18 secured on the shaft of the platen 14 is operatively associated with a pawl 19 pivotably mounted on and loaded against a pivoted line space lever 20 by means of a pawl spring 21. Operation of the line space lever 20 against the bias of a lever return spring 22 causes the pawl 19 to index the ratchet to effect line spacing.

The pulley 17 of the carrier drive system and a gear 24 affixed thereto are rotatably mounted on a shaft 23. A drive gear 25 driven by a motor 26 is in mesh with gear 24 thereby to drive the pulley 17 in opposite rotary directions according to the direction of energization of the motor 26.

Also meshing with gear 24 is a gear 27 which is secured on a shaft 28 on which a coiled spring 29 of a wrap spring clutch is wrapped. In the embodiment shown, a bent out end 30 of the spring 29 is secured to a clutch control plate 31, rotatably mounted on shaft 28. The clutch control plate 31 is provided with 180° spaced stops 32 and is held against rotation by the engagement of armature 33 of an electromagnet 34 with one of the stops 32. In this condition the spring 29 is held unwrapped from shaft 28 and the clutch is disengaged.

The clutch control plate 31 and a rotary drive cam plate 35 comprise a unit rotatably mounted on shaft 28. The cam plate 35 has two increasing radii cam surfaces 36 which when the cam plate 35 is rotated 180°, act against a tab 37 on and to drive a lever 38 pivotably mounted at its lower end about a pin 39. A pull band 41 is connected between the upper end of the pivoting lever 38 and, via guides 42, to the line space lever 20 carrying the pawl 19 whereby the pawl 19 will index the ratchet 18 and the platen 14.

With reference to FIGS. 1 and 3 the sequence of operations upon each actuation of a character key on a keyboard 44 is such that a microcomputer 43 causes the motor 26 to be energized and drive in the rotary direction of arrow A which winds strand **16*a* of cable 16 clockwise on the pully 17, and unwinds strand 16*b* thereby to advance the carrier 13 one character space to the next typing position. Simultaneously the selected character spoke on the typewheel 11 is positioned by motor 12 in accordance with signals issued by microcomputer 43. Thereafter the microcomputer 43 issues a signal to a hammer magnet (not shown) to print the character. The process repeats until the end of a typed line is reached. If, as seen from the flow chart of FIG. 3 the key actuated is determined to be a carrier return key, and if the carrier 13 is positioned more than 6 character spaces from an established left margin LM, the logic causes the line space magnet 34 to be energized briefly thereby moving the armature 33 to release the clutch control plate 31 so that the clutch spring 29 will be allowed to wrap and couple the cam plate 35 to the carrier drive gear 24. Simultaneously the motor 26 is energized in the rotary direction B, i.e. opposite to that during a typing operation. This causes the gear 24 and the pulley 17 to turn in the direction of arrow C and the strand 16***b* of cable 16 to pull the carriage 13 in the return direction of arrow D. This pull, and with it the motion of the carriage 13, continues until the motor 26 is deenergized via a limit switch (not shown) at the established left margin.

The energized motor 26, via the wrapped spring clutch drives the cam platen 35 secured for rotation with the clutch control plate 31 in the direction of arrow E. Thus one of the cam surfaces 36 of the cam plate 35 pivots the pivoting lever 38 so as to operate the line space lever 20 by means of the pull band 41 with the result that the pawl 19 turns the ratchet wheel 18, and with it the platen 14, counterclockwise. After 180° rotation, the next following tooth 32 of the clutch control plate 31 will be intercepted by the armature 33 of the now de-energized electromagnet 34 whereby the clutch spring 29 unwraps and the clutch is opened or declutched, thus the rotary motion of the cam plate 35 ceases also. Thus, if the carrier 13 is positioned more than a predetermined number of spaces from the established left margin position, LM, the carrier drive motor 26 will be energized over an interval, and rotate through an angle, such that the wrap spring clutch will be driven through a full 180° cycle and complete a line indexing movement before the carrier 13 reaches the left margin position.

As will be evident, if a carrier return were signalled when the carrier 13 is positioned less than a predetermined number of spaces from the established left margin, LM, the time of energization of the motor necessary to drive the carrier 13 back to the left margin would not be long enough to produce a rotation of the wrap spring clutch through 180°, with the result that a full line space would not be accomplished.

In accordance with the invention complete line spacing is assured, notwithstanding the carrier 13 may be positioned less than a predetermined number of spaces from the established left margin at the time a carrier return is signalled.

More particularly having reference to FIG. 2, the predetermined distance from the established left margin is indicated to be at least 6 character spaces measured from the left margin, LM. The energization of the carrier drive motor 26 over the time interval necessary for the carrier to traverse 6 spaces will also result in rotation of the motor 26 through an angle sufficient to drive the wrap spring clutch 180°. The 6 spaces are shown to define a zone X. Thus if the carrier 13 is within zone X, for example at character position 3, when a carrier return is signalled, logic in the form of a counter in the microprocessor 43, which keeps track of the position of the carrier 13 relative to an established left margin LM, will indicate that it contains a value smaller than or equalling six. In this event, no signal will be issued to energize the magnet 34 and the carrier drive motor 26 will be energized to turn in the direction of arrow A, thereby to moving the carrier 13 in typing direction A1 until it moves beyond Zone X. Thus, the carrier drive motor 26 will be denergized and carrier movement in direction A1 ended when the step counter exceeds the value six. At this time the microprogram will then cause the clutch magnet 34 to be energized as well as the carrier drive motor 26 but in direction B opposite to the escapement direction A. This causes, as described above, the line spacing of the platen 14 to be performed on the one hand, and the carriage 13 to be returned to the left margin of a typed line on the other. Thus the result is that if a carrier return key is actuated while the carriage 13 is in a predetermined zone X adjacent the left margin, the carriage 13 is first moved in typing direction by a relatively small beyond the zone X and only then in return direction. This assures that the time of motor energization to return the carrier 13 to the left margin is sufficient to execute a line spacing movement.

The invention claimed is:

1. A typewriter having a frame, a platen rotatably mounted on said frame, a single element type carrier mounted for movement in escapement and carriage return directions relative to said frame between established left and right margins, a bidirectional motor, carrier drive means connected to said motor for moving said carrier in escapement and return directions according to the direction of energization of said motor, platen indexing means, a normally disengaged half revolution clutch coupled to said carrier drive means and operable when energized to couple said carrier drive means to said platen indexing means to effect upon energization of said motor over the full cycle of the engaged clutch, a line indexing movement during the return of said carrier to said left margin, means for generating a carrier return command, control means for energizing said bidirectional motor to move said carriage and said clutch in response to said carrier return command, means responsive to said carrier return command for determined the distance of said carrier from said established left margin;

said control means energizing said motor in escapement direction if the determined distance is less than a predetermined number of spaces and then energizing said motor in carrier return direction and said clutch when the determined distance is greater than said predetermined number of spaces.

2. A typewriter having a frame, a platen rotatably mounted on said frame, a single element type carrier mounted for movement in escapement and carriage return directions relative to said frame between established left and right margins, a bidirectional motor, carrier drive means connected to said motor for moving said carrier in escapement and return directions according to the direction of energization of said motor, platen indexing means, means for coupling said platen indexing means to said carrier drive means upon energization of said motor in carrier return direction, means for generating a carrier return signal, and control means responsive to said carrier return signal for determining whether the distance from said left margin to said carrier is less or greater than a predetermined distance and if said distance is greater than said predetermined distance, for energizing said motor in carrier return direction or if said distance is less than said predetermined distance, for energizing said motor in escapement direction until said predetermined distance is achieved and then energizing said motor in carrier return direction.

3. A typewriter having a frame, a platen rotatably mounted on said frame, a single element type carrier mounted for movement in escapement and carriage return directions relative to said frame between established left and right margins, a bidirectional motor, carrier drive means connected to said motor for moving said carrier in escapement and return directions according to the direction of energization of said motor, platen indexing means, coupling means operable when energized to couple said platen indexing means to said carrier drive means to effect indexing of said platen incident to return movement of said carrier, means for generating a carrier return signal, and control means operative in response to said carrier return signal for determining the distance of said carrier from said left margin position and for energizing said coupling means and said motor to effect return movement of said carrier to said left margin position if said carrier is at least a predetermined distance from said left margin position, and for energizing said motor to effect escapement movement of said carrier beyond said predetermined distance and then energizing said coupling means and said motor to effect return movement of said carrier to said left margin position if said carrier is less than a predetermined distance from said left margin position.

* * * * *